US008615838B1

(12) United States Patent
Lu

(10) Patent No.: US 8,615,838 B1
(45) Date of Patent: Dec. 31, 2013

(54) BARBEQUE GRILL BRUSH

(75) Inventor: James Lu, Alpharetta, GA (US)

(73) Assignees: International Business Corporation, Alpharetta, GA (US); Progressive Global Enterprises Co., Ltd., Taipei (TW)

( * ) Notice: Subject to any disclaimer, the term of this patent is extended or adjusted under 35 U.S.C. 154(b) by 205 days.

(21) Appl. No.: 13/373,374

(22) Filed: Nov. 14, 2011

(51) Int. Cl.
*A47L 13/12* (2006.01)
*A47L 17/06* (2006.01)

(52) U.S. Cl.
USPC ..... 15/111; 15/160; 15/236.01

(58) Field of Classification Search
USPC ..... 15/111, 160, 236.03–236.06, 236.01, 15/236.09, DIG. 5
See application file for complete search history.

(56) References Cited

U.S. PATENT DOCUMENTS 3,094,728 A * 6/1963 White ..... 15/111
5,373,600 A * 12/1994 Stojanovski et al. ..... 15/111

* cited by examiner

*Primary Examiner* — Shay Karls
(74) *Attorney, Agent, or Firm* — Rodgers & Rodgers

(57) ABSTRACT

A barbeque grill brush including a handle with the head portion attached thereto, multiple metal bristles embedded in the bottom of the head portion, a pair of spaced L-shaped arms attached to the bottom of the head portion, and an elongated bumper spaced from the head portion and end being interconnected to the L-shaped arms.

6 Claims, 2 Drawing Sheets

BARBEQUE GRILL BRUSH

BACKGROUND OF THE INVENTION

Barbeque grill brushes have been widely used to thoroughly and efficiently clean conventional barbeque grill grates. This is generally accomplished by using a brush having stiff metal bristles to remove grease and food particles from a grill grate by simply scrubbing the brush across the top of the grate. Historically grill brushes have been very effective in cleaning barbeque grills, but a problem arises when utilizing the brush in a typical up and down cleaning motion which causes portions of the brush to come into contact with an extremely hot grill. Since virtually all brushes are manufactured of molded plastic, whenever a portion of the plastic comes into contact with a hot grill, it at least partially melts. When this occurs, some of the bristles tend to fall out and the brush itself becomes undesirably unsightly.

BRIEF SUMMARY OF THE INVENTION

A grill brush is provided to prevent plastic portions of the brush from coming into contact with a heated grill grate and includes a handle with a head portion attached to one end thereof, multiple metal bristles embedded in the bottom of the head portion, and at least one rail attached to the head portion bottom adjacent the bristles and having an elongated bumper at least partially spaced from the bottom of the head portion and extending substantially the width of the head portion.

DETAILED DESCRIPTION OF THE INVENTION

Figure 1:
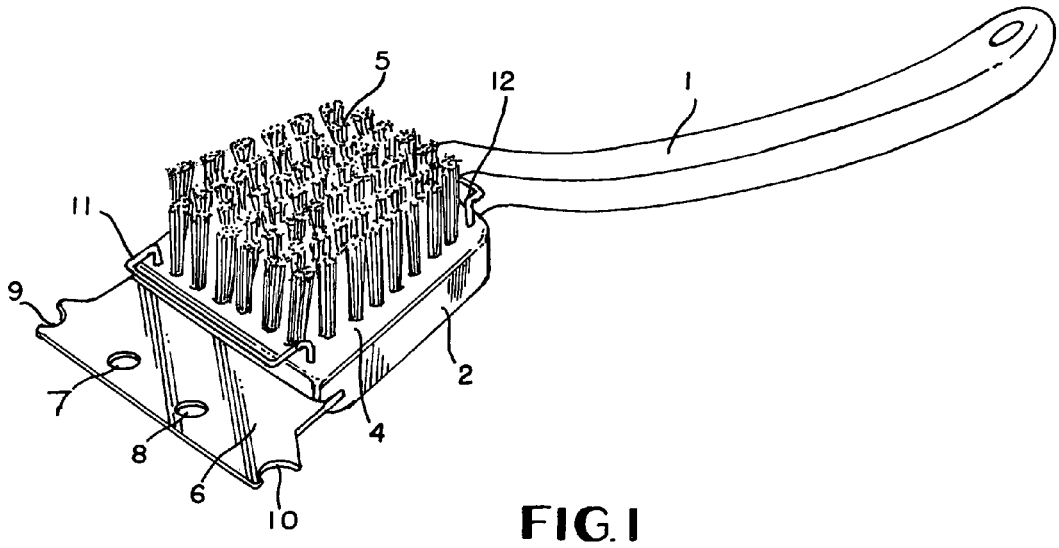
FIG. 1 is a perspective view of a barbeque grill brush according to this invention.

In the drawings and with particular reference to FIG. 1, the barbeque grill brush, according to this invention, is shown and includes elongated handle 1 with head portion 2 integrally joined to one end of elongated handle 1 and extending generally angularly outwardly therefrom. Head portion 2 includes spaced top 3 and bottom 4 which are shown in an inverted disposition in FIG. 1. Multiple bristles 5 extend from bottom 4 of head portion 2 and are embedded in bottom 4 in a conventional manner.

As is well known, scraper 6 is attached to the distal end of head portion 2 and includes apertures 7 and 8. Further, semicircular elements 9 and 10 are formed, respectively, on the opposite ends of scraper 6 and are used to scrape and clean the individual elongated grate elements, as is well known in the art.

Figure 2:
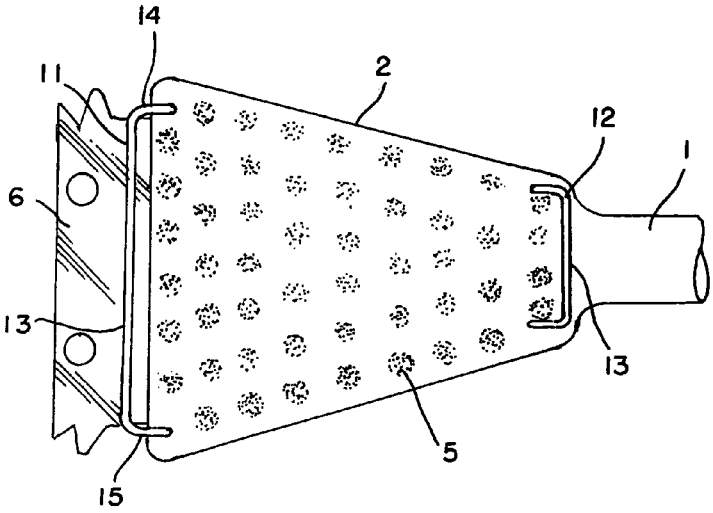
FIG. 2 is a plan view of the brush head portion shown from below.
Figure 3:
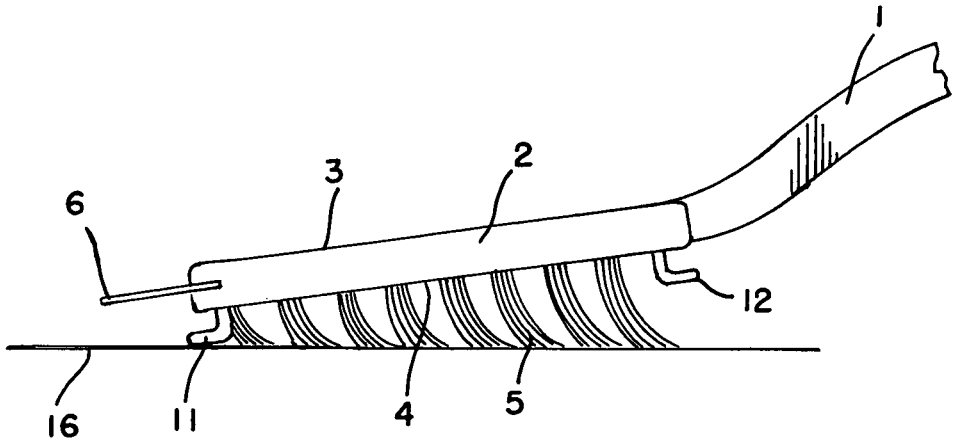
FIGS. 3 and 4 are side elevational views depicting operation of the barbeque grill brush.
Figure 4:
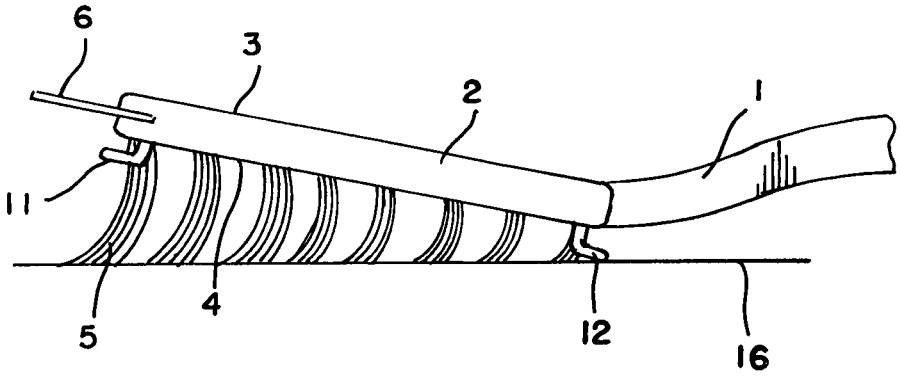

According to this invention, the barbeque grill brush is provided with a pair of spaced rails 11 and 12 which are suitably and securely embedded in bottom 4 of head portion 2. Each rail 11 and 12 includes an elongated bumper 13 with a pair of L-shaped attachment arms 14 and 15 extending, respectively, from the ends of bumper 13 inwardly of head portion 2 and then downwardly, as viewed in FIGS. 1 and 2. L-shaped attachment arms 14 and 14 are suitably secured in bottom 4 of head portion 2, as shown in FIGS. 3 and 4. Rail 11 extends downwardly from head portion 2 and outwardly in a distal direction beyond bristles 5 and, likewise, rail 12 extends downwardly from head portion 2 and inwardly in a proximal direction toward handle 1. Both rails 11 and 12 extend outwardly beyond the respective edge of head portion 2 disposed therebelow so as to insure that head portion 2 does not come into contact with the hot grate as it is being cleaned.

Although an elongated handle 1 is shown in the drawings, this invention is equally well suited to grill brushes which feature a C-shaped handle whereby both ends of the handle are attached to head portion 2. In addition, this invention is applicable to grill brushes which feature bristles 5 extending from both top 3 and bottom 4 of head portion 2.

In a typical scraping motion, a user rotates or rocks handle 1 in an up and down fashion which heretofore caused the front and rear portion of molded plastic head portion 2 to come in contact heated grill grate 16. By this invention, whenever handle 1 is rotated either upwardly or downwardly, respective rails 11 and 12 will prevent any contact between head portion 2 and the heated grill grate. That is, when handle 1 is lifted, rail 11 will come in contact with grill grate 16 and prevent further rotation of the grill brush, as shown in FIG. 3. Likewise, as shown in FIG. 4, whenever handle 1 is rotated downwardly, rail 12 will come in contact with the heated grill grate 16 and thereby stop the downward rotation of the grill brush. Therefore, by this invention, during use head portion 2 never comes in contact with the heated grill grate and any possible melting of head portion 2 is thereby prevented.

The invention claimed is:

1. A grill brush comprising a handle having proximal and distal ends, a head portion extending from said distal end, said head portion having a spaced top and bottom, multiple bristles extending from said bottom, a rail secured to said bottom, said rail comprising an elongated bumper, said bumper being spaced from said bottom, said bumper comprising oppositely disposed ends, and a pair of L-shaped arms joined respectively to said ends.

2. A grill brush according to claim 1 wherein said L-shaped arms are attached to said head portion bottom opposite said ends.

3. A grill brush according to claim 1 wherein a scraper extends from said head portion opposite said handle.

4. A grill brush according to claim 1 wherein a second rail is secured to said bottom.

5. A grill brush according to claim 1 wherein said bumper extends outwardly from said bristles and beyond the adjacent edge of said head portion.

6. A grill brush comprising a handle having proximal and distal ends, a head portion extending from said distal end, said head portion having a spaced top and bottom, multiple bristles extending from said bottom, a rail secured to said bead portion, said rail comprising an elongated bumper, said bumper being spaced from said head portion and comprising oppositely disposed ends, a pair of arms joined respectively to said ends and interconnecting said bumper and said head portion, and said bumper extending outwardly beyond the edge of said head portion disposed remote from said handle.

* * * * *